United States Patent [19]

Drevet

[11] 3,957,003

[45] May 18, 1976

[54] SIMPLIFIED CONTROL MECHANISMS FOR SEWING MACHINES

[76] Inventor: Georges Drevet, 24 rue Francisque Voytier, 42100 Saint-Etienne-Loire, France

[22] Filed: Apr. 10, 1974

[21] Appl. No.: 459,683

[30] Foreign Application Priority Data

Apr. 13, 1973 France ..... 73.14268

[52] U.S. Cl. ..... 112/158 R; 112/221; 112/158 D

[51] Int. Cl. ..... D05b 3/02

[58] Field of Search ..... 112/158 R, 158 D, 221

[56] References Cited

UNITED STATES PATENTS

| | | | |
|---|---|---|---|
| 3,353,509 | 11/1967 | Reeber et al. | 112/158 R |
| 3,426,709 | 2/1969 | Jindrich et al. | 112/158 R |
| 3,460,496 | 8/1969 | Meier | 112/158 R |
| 3,696,768 | 10/1972 | Torii | 112/158 R |

*Primary Examiner*—H. Hampton Hunter
*Attorney, Agent, or Firm*—Haseltine, Lake & Waters

[57] ABSTRACT

A control mechanism for the synchronized operation of the hook, the fabric feeding latch and the needle bar of a sewing machine comprising a main drive shaft driving two juxtaposed eccentrics, one connected through a drive mechanism to the hook for imparting oscillatory movement thereto, the second being drivingly connected through a second mechanism to the fabric feeding latch for imparting oscillatory movement thereto which is synchronized with the oscillatory movement of the hook. The mechanism connecting the second eccentric to the fabric feeding latch includes an adjustable arrangement for adjusting both the stroke of the feeding latch and the direction of its oscillation. The main drive shaft also drives the needle bar through an adjustable mechanism by which the amplitude of zig-zag stitches can be adjusted as well as the centered position of the needle bar. The needle bar is driven in up and down movement from the main shaft through a mechanism with an eccentric which slidably and guidably supports the thread tensioning lever. The needle bar is so constructed that the needle can be inserted in a singular position thereinto, and the needle plate is mounted on the frame of the machine, through the intermediary of studs which cooperate with sloping faces of a slot formed in the frame and resilient tongues which engage beneath the faces of the slot.

15 Claims, 20 Drawing Figures

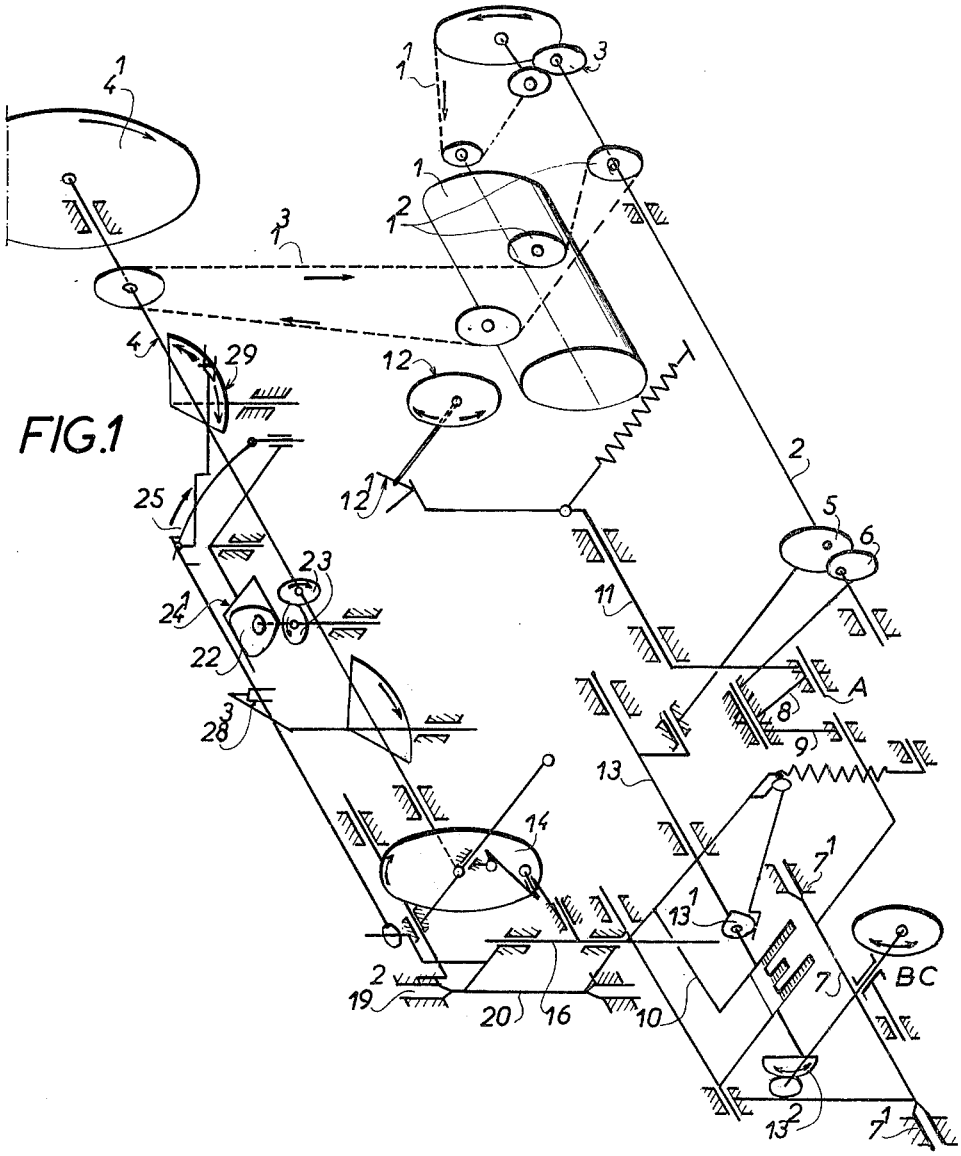
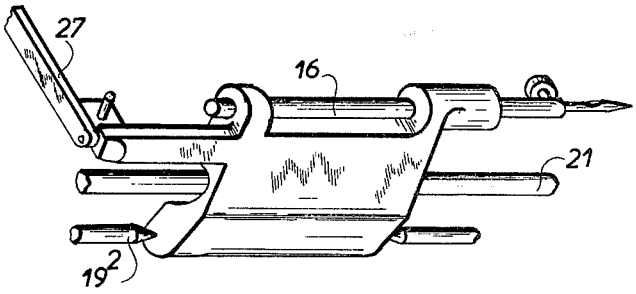
FIG.14

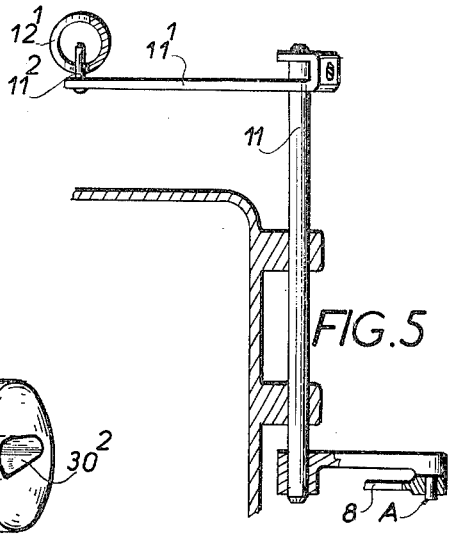
FIG.5
FIG.17
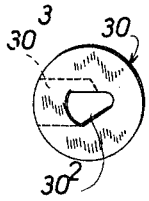
FIG.16
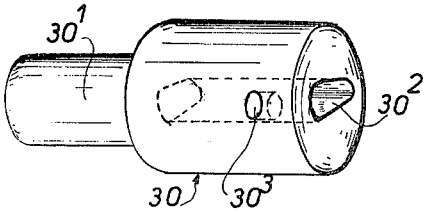
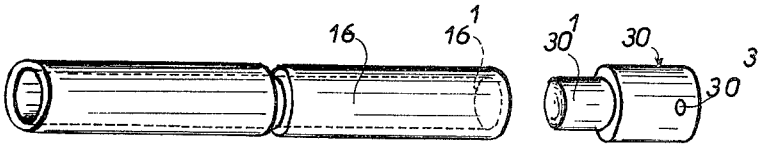
FIG.15
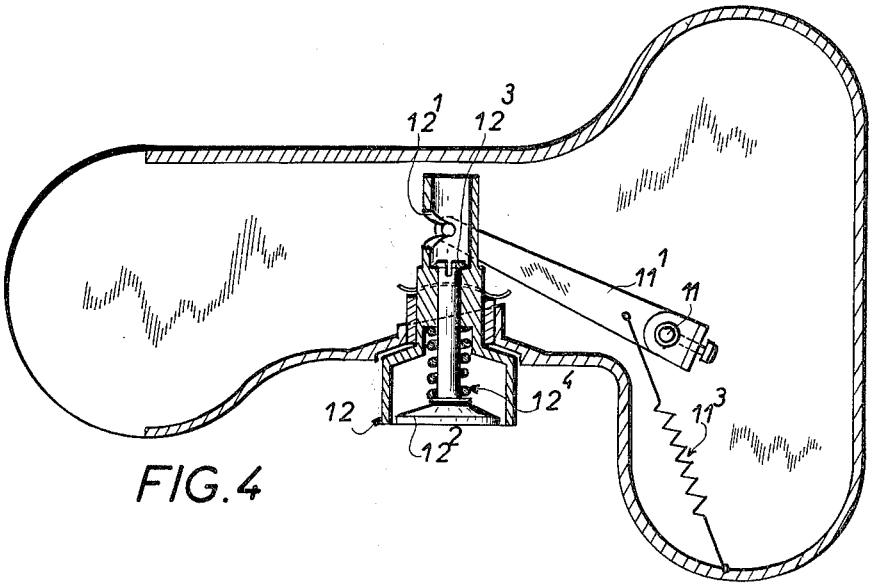
FIG.4

26²
24²
24
25
26
4
24¹
22
27¹
24³
29
29¹
29²
23
28³
28⁴
27
28¹
28
28²

22
24¹
26²
25¹
20
21
27
28³
26
28
29

22
24¹
26²
25¹
20
28³
26¹
21
26
27
28
29
28²
29²

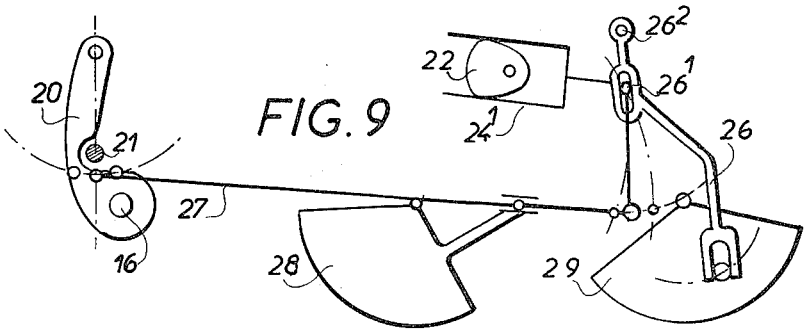
FIG. 9
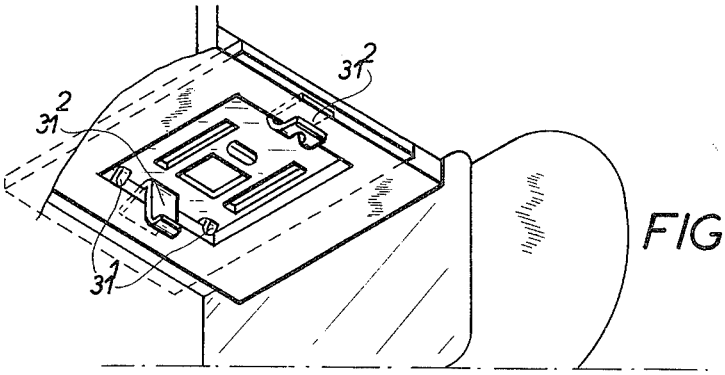
FIG. 18
FIG. 19
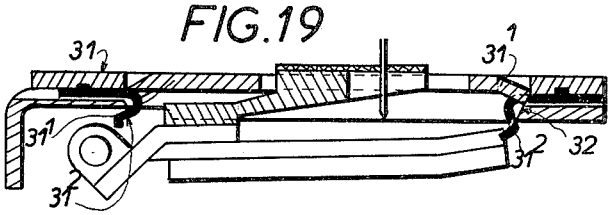
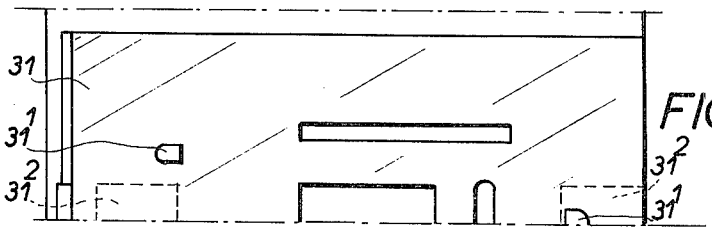
FIG. 20

SIMPLIFIED CONTROL MECHANISMS FOR SEWING MACHINES

The invention relates to simplified control mechanisms for sewing machines.

The invention is particularly concerned with apparatus for sewing, embroidery and similar operations.

The control mechanisms of a sewing machine are often complicated and require numerous elements, whose cost price is high and the durability of which is very limited. The adjustments for synchronizing the relative movements of the feeding claws or latches for the fabric and of the hooks are difficult. The control means of the tensioning lever is also of a complicated design. Similarly, the systems for controlling the amplitude of the "zig-zag" and also the adjustment of the stitch length requires numerous manipulations. Since the position of the needle in the needle holder has to be very precise, the operator must give very particular attention to this operation.

It is for the purpose of obviating these numerous inconveniences that the invention contemplates simplified control mechanisms for a sewing machine.

One of the features of these mechanisms consists in the juxtaposition of two eccentrics, which may or may not be integral, mounted on the same shaft which is driven by the motor and disposed in the lower part of the machine, one of these eccentrics controlling the alternating rotation of the hook and the other permitting the variation in amplitude of the fabric feeding latch. The synchronizing adjustments of the relative movements of the latch and of the hook are thus made decidedly more simple.

According to another feature, a cam mounted on an oscillating shaft and controlling the ascending and descending movements of the fabric feeding latch forms a pinion transmitting the alternating movement to the hook.

The variation in amplitude of the latch, thus defining the stitch length and the direction of movement of the fabric, is made possible by a knob, characterized in that the knob is a solid knob having a V-shaped slot in which is displaced a pin connected to a system permitting variation in the position of the pivot point of two rods fast with the juxtaposed eccentrics and controlling the movement of the fabric feeding latch. In addition, the solid knob has a sliding part which, in its inwardly pressed position, reverses the direction of movement of the fabric.

According to another feature, the thread tensioning lever is of prismatic section and is pivoted at one of its ends so as to be slidable movement in a sliding block in one or two parts, which is free in rotation and mounted fast and eccentrically on a crank pin also permitting the rise and fall of the needle bar. The tensioning lever can be in one or two parts. The rotation of the crank pin imparts to the tensioning lever an alternating movement of slow descent and fast ascent. The prismatic form of the tensioning lever ensures perfect guiding without any play. The movement of the thread tensioning lever is synchronized with that of the needle bar.

The movement called a "zig-zag" movement of the needle-holding bar is transmitted in known manner by a control bar, one end of which, having a roller, is displaced and is adjustable in position in a curvilinear ramp. The curvilinear ramp has an alternating movement of small amplitude, which is transmitted to it by a fork co-operating with a cam to which is given a rotational movement. The differences in amplitude of the zig-zag movement are obtained by spacing the roller or cam follower of the control bar to a greater or lesser extent from the pivot pin of the curvilinear ramp. The centering of the stitch to the right or to the left is obtained by displacing the pivot pin of the said curvilinear ramp being displaced towards the right or left. According to the invention, this control of the amplitude or range of movement, and also the positioning towards the right or left of the needle, is simplified through the intermediary of knurled sectors with adjustable and elastic leaf springs for supporting and positioning purposes.

It is to be noted that one of the pivot points on which is mounted the oscillating arm carrying the needle bar is adjustable with a translatory movement in order to obtain a strict alignment of these two points at the time of assembly.

According to another feature, the end of the needle-carrying bar is a separate part of sintered metal or a part obtained in some other way by precision moulding, inside which is formed an orifice having exactly the shape of the heel of the needle. Hence, by this simple arrangement, the operator has only one possibility of fitting the needle in the bar, thus eliminating any danger of error.

The needle plate is fixed in the frame by two clips and is positioned by two studs which give the plate a very precise and and judiciously calculated position. These arrangements permit easy removal and a strict positioning.

These features and also others will hereinafter become apparent from the following description.

In order to describe the invention in greater detail without, however, limiting it, reference is made to the illustrated embodiment in the accompanying drawings, in which:

FIG. 1 is a very diagrammatic view of the kinematic chain of the control mechanism of the sewing machine.

FIG. 4 is a sectional view of the control button for the stitch length and the direction of movement of the fabric, mounted in the supporting frame of the sewing machine.

FIG. 5 is a sectional view corresponding to FIG. 4, illustrating the means for shifting the pivot point of the rods connected to the eccentrics.

FIGS. 7, 8 and 9 are very diagrammatic views illustrating the different positions of the needle bar support and of the members which are connected thereto.

FIG. 14 is a perspective view of the needle bar support.

FIG. 15 is a perspective view of the needle bar assembly and its separate end.

FIG. 16 is a perspective view to a larger scale of the separate end of the needle bar.

FIG. 17 is an underneath view of the separate end of the needle bar.

FIG. 18 is an underneath perspective view of the needle plate and illustrating the means permitting the fixing thereof.

FIG. 19 is a sectional view of the needle plate.

FIG. 20 is a top view of half of the needle plate.

Figures 2, 3:
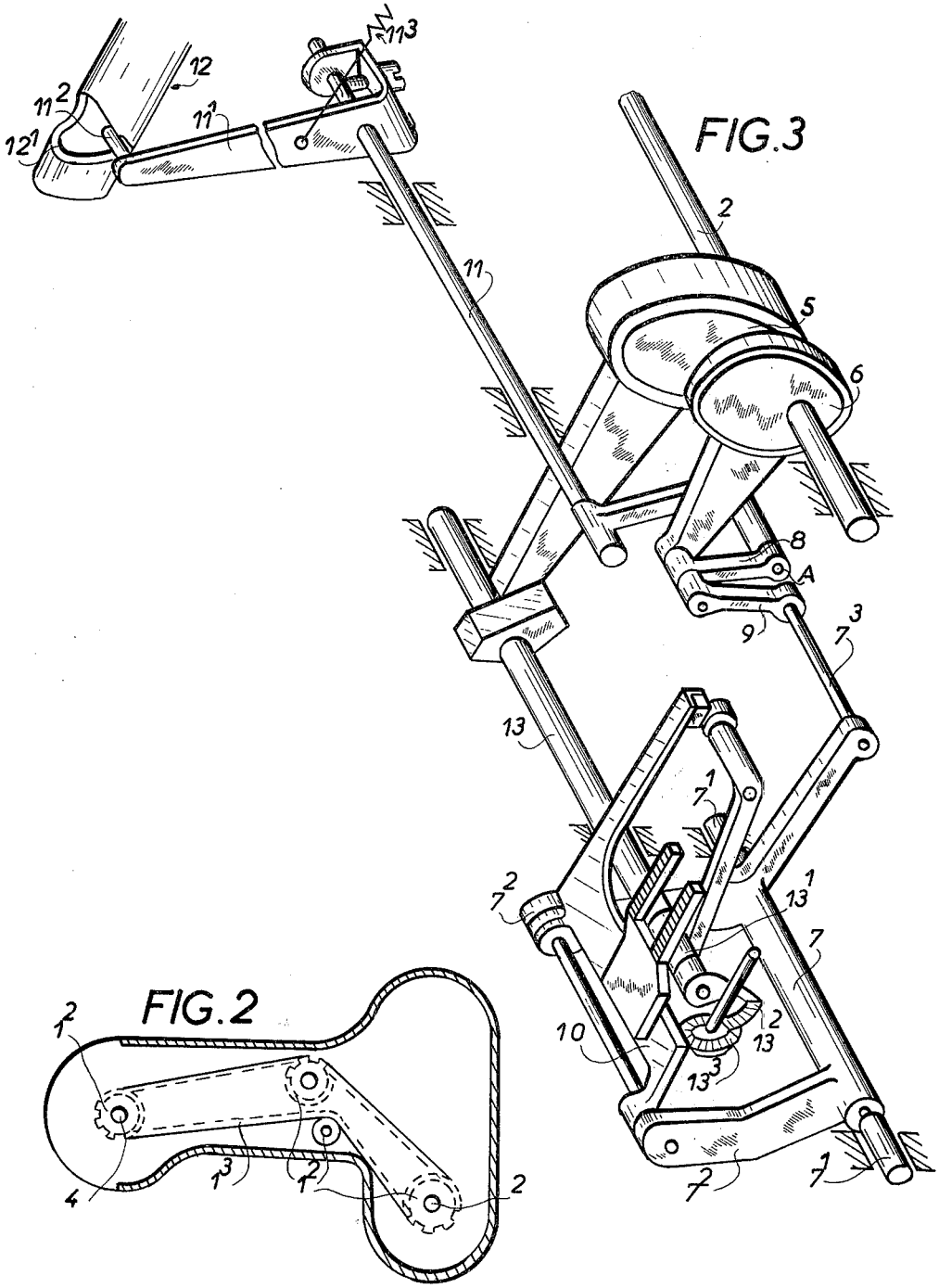
FIG. 2 is a view from the side and in section of the sewing machine, illustrating the movement-transmission members.
FIG. 3 is a perspective view of the mechanism arranged in the bottom part of the machine, illustrating the means for feeding the fabric.
Figure 6:
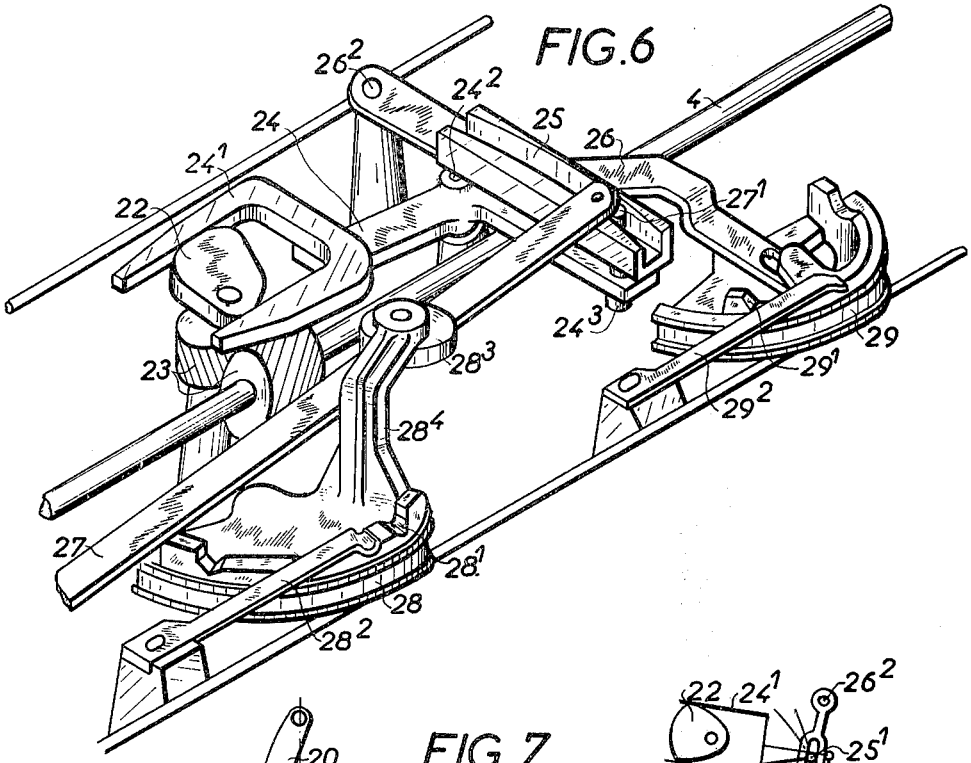
FIG. 6 is a perspective view of the means for controlling the zig-zag stitch, to the right and to the left.
Figure 7:
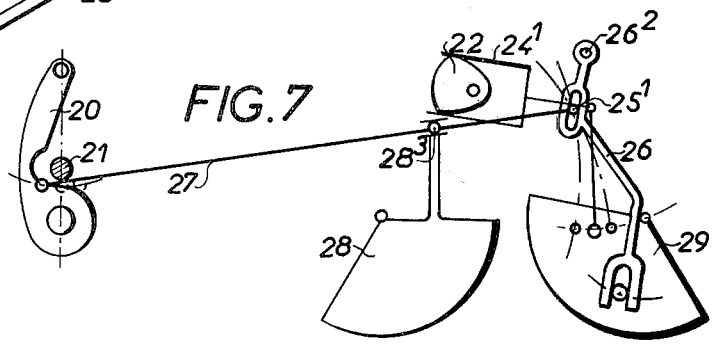
Figure 8:
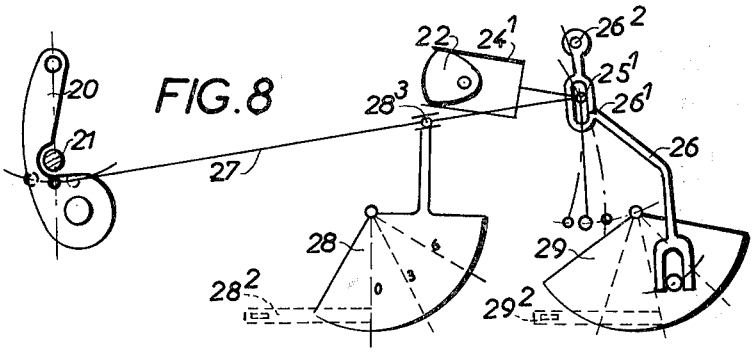
Figure 10:
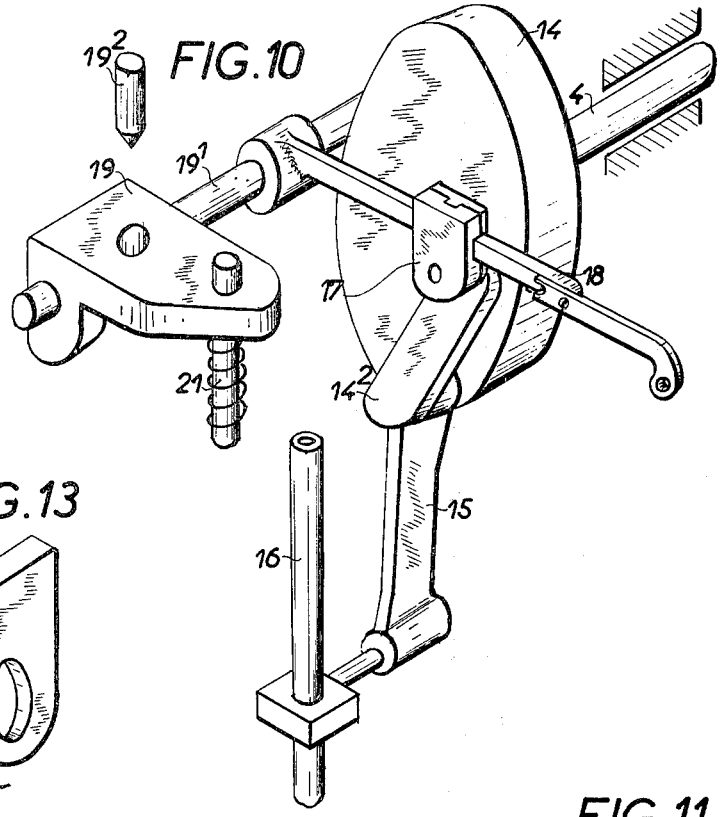
FIG. 10 is a perspective view of the simplified system for the thread tension and the rise and fall of the needle bar.
Figure 13:
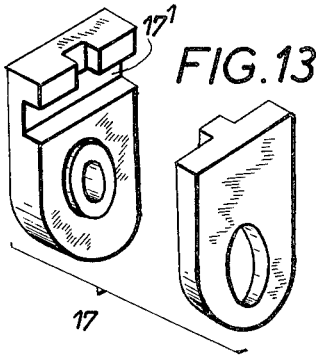
FIG. 13 is a perspective view of the prismatic supporting and guiding slide for the tensioning lever.
Figure 12:
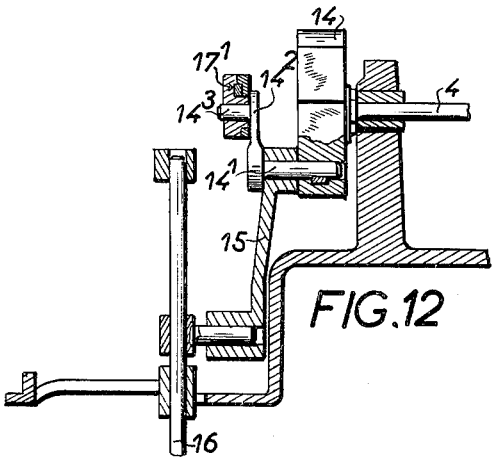
FIG. 12 is a view from the right and in section, corresponding to FIG. 11.
Figure 11:
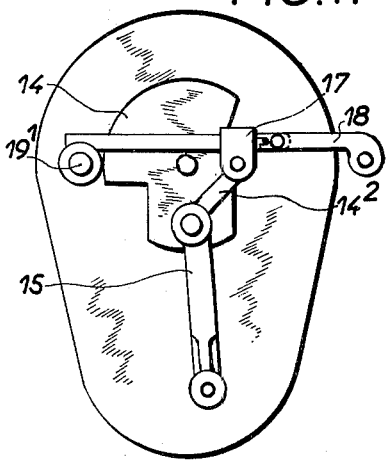
FIG. 11 is an end view of the simplified system for the thread tension and the rise and fall of the needle bar.

In order that the object of the invention may be made more specific, the latter is described in a non-limiting manner and by reference to the embodiment which is illustrated by the Figures in the drawings.

The rotational movement is transmitted by a motor element 1 to a shaft 2 by means of a trapezoidal belt $1^1$, or any other suitable means for transmitting rotational movement, and a reduction gear assembly 3. The rotational movement of a shaft 2 is transmitted to the shaft 4 situated in the upper part of the sewing machine by a system of pulleys $1^2$ and a serrated belt $1^3$ or any other suitable means for transmitting rotational movement.

The shaft 2 carries two juxtaposed eccentrics 5 and 6, which may or may not be integral. The eccentric 6 transmits an oscillating movement of variable amplitude to a supporting arm 7 by means of rods 8 and 9. The supporting arm 7, mounted between pivot points $7^1$, carries two levers $7^2$, on which the feeding dog or latch assembly 10 for the fabric is mounted for free rotation.

The variation in the oscillation amplitude of the feeding latch 10 controlled by the supporting arm 7 is permitted by the displacement of the pivot point A of the rods 8 and 9 fast with the eccentric 6. This displacement of the pivot point is effected by a rotation of small amplitude of a shaft 11 fast with a lever $11^1$ having a finger or pin $11^2$.

By effecting rotational movement of a solid knob 12 for regulating the stitch length, the pin $11^2$ slides in V-shaped slot $12^1$ formed at one end of the regulator knob 12, thus causing the rotation, by a small amount, of the shaft 11 and consequently the displacement of the pivot point A. The pin $11^2$ is constantly held against the front face of the V-shaped slot by a return spring $11^3$ or any other resilient means fixed on the lever $11^1$. When pressure is applied to the central part $12^2$ of regulator button 12, the end $12^3$ of said central part applies pressure to the pin $11^2$ and brings it in contact with the rear face of the V-shaped slot $12^1$. This causes the rotation of the shaft 11 and consequently the displacement of the pivot axis A of the rods 8 and 9 beyond the axis formed by the rod $7^3$, coupling the supporting arm 7 and the rod 9. This displacement of the pivot axis A permits the fabric to be displaced in the other direction. The knob 12 for regulating the stitch length and for changing the direction of movement of the fabric is recessed in the stand or frame, while its central sliding part $12^2$ is held retracted by a spring $12^4$, and is stopped in its translatory movement by a resilient shoulder forming the end $12^3$ of the sliding part $12^2$ and being recessed in the knob 12.

The oscillatory movement of the hook or looper BC is effected by a cam $13^1$ mounted on a shaft 13 given an oscillatory movement which is transmitted by the eccentric 5. The cam $13^1$ forms a conical toothed sector $13^2$ which, by means of a conical pinion $13^3$, imparts to the hook BC an oscillatory movement which is synchronized with the rising and falling movement of the latch.

The upper shaft 4, one end of which has a flywheel $4^1$, is given a rotational movement. Mounted on the other end of the shaft 4 is a crank 14 having a fixed pivot pin $14^1$ which is eccentric in relation to the axis of rotation of shaft 4. Mounted for free rotational movement on the fixed pivot pin 14′ is a rod 15 which is fast with the needle bar 16. Fixed to the free end of the pivot pin $14^1$, by soldering or other fixing means, is an arm $14^2$ which is disposed obliquely in relation to the axis of displacement of the needle bar. Mounted to be freely rotatable on a pin $14^3$ fast with the arm $14^2$ is a slide block 17 of synthetic or other material and assembled in one or two parts, the block having a prismatic groove $17^1$ inside which slides, without any play, a tensioning lever 18 of prismatic section, in one or two parts. The tensioning lever 18, having a slow downward movement and a fast upward movement, is pivoted on a pivot pin $19^1$ fixed on a support 19 carrying an adjustable position pivot point $19^2$ of an oscillating arm 20 carrying the needle bar 16.

The support 19 has the particular feature of being adjustable longitudinally so as to permit the alignment of the upper pivot point $19^2$ of the oscillating arm 20 carrying the needle bar 16 with the lower pivot point fixed in the frame.

The support 19 is also used as an upper guide for the fabric presser foot 21. It is to be noted that the oscillating arm 20 is made of any synthetic material, thus preferably avoiding all heat or other treatments.

The oscillatory movement of the needle, called the zig-zag movement, is obtained from a cam 22 which is given a rotational movement transmitted by a pair of helical and possibly conical gears 23, one of which is mounted on the shaft 4. The cam 22, cooperating with a fork $24^1$, fast with a squared arm 24, transmits an oscillating movement to the arm 24, which is articulated on a fixed pivot $24^2$. A curvilinear ramp 25 is articulated on a pivot pin $24^3$ at the free end of the squared arm 24. The curvilinear ramp has a pivot pin $25^1$ co-operating with a slot $26^1$ formed in the arm 26.

A lever 27 which is fast with the oscillating arm 20 has a roller $27^1$ which slides inside the curvilinear ramp 25.

By the rotation of a knurled sector 28 of synthetic material, preferably acting on the lever 27, the position of the roller $27^1$ inside the curvilinear ramp 25 is modified. Thus, by the roller being spaced further from or brought closer to the pivot pin $25^1$ of the ramp 25 co-operating with the slot $26^1$ formed in the arm 26, the alternating translatory movement of the lever 27 is increased or reduced, and consequently so is the oscillatory movement of the needle bar 16. Moreover, by rotation of a knurled sector 29, also made of synthetic material, there is produced oscillation of the lever 26 articulated on a fixed pivot pin $26^2$ to displace the pivot point of the curvilinear ramp 25. This produces translatory movement of the lever 27 and consequently that of the needle bar 16, with a view to obtaining a stitch to the right or left.

It is important to note that, according to the invention, the knurled sectors 28 and 29 respectively have notches $28^1$ and $29^1$ which co-operate with adjustable resilient leaf springs $28^2$ and $29^2$. The notches $28^1$ define differences in amplitude of the zig-zag stitch, while the notches $29^1$ define the different positions of the needle.

The connection of the serrated sector 28 with the lever 27 is obtained by a roller $28^3$, mounted to be freely rotatable on an arm $28^4$ which is fast with the sector 28, having a diametral groove into which the lever 27 extends for sliding movement.

As illustrated in FIGS. 15, 16 and 17, the end 30 of the needle bar 16 is cylindrical and is made of sintered metal or obtained by precision moulding, bar 16 having a shoulder $30^1$ which extends into and is positioned in the orifice $16^1$ formed in the tubular needle bar 16. The separate end 30 also has an opening $30^2$ which has exactly the shape of the heel of the needle; this arrangement assures the precise and singular position of the needle in relation to the other members of the sewing machine. The needle is held in the separate end 30 by a locking screw which co-operates with a threaded opening $30^3$ formed in the said end 30.

The needle plate 31, which is well-known in the art, must have a precise position in the frame and for this purpose it is provided with positioning tongues $31^1$ co-operating with sloping faces 32 of an opening formed in the frame. The needle plate 31 is held on the frame by at least two resilient hooks $31^2$ which are fast with the plate and are engaged beneath the faces of the opening.

It is to be noted that all the simplified control mechanisms as described above can be mounted together or separately in all the mechanisms of all sewing machines.

The invention is not in any way limited to that of its forms of application or to those of the constructional forms of the various parts which have been more specifically indicated; on the contrary, it covers all the possible variants.

I claim:

1. In a zig-zag sewing machine having a hook or looper, a fabric feeding dog or latch and a needle bar, a control mechanism for the synchronized operation of the hook, the fabric feeding latch and the needle bar of the sewing machine, said mechanism comprising a main drive shaft, two juxtaposed eccentrics driven by said main drive shaft, first means including a cam drivingly connecting one eccentric to the hook for imparting oscillatory movement thereto, second means drivingly connecting the second eccentric to the fabric feeding latch for imparting oscillatory movement to the fabric feeding latch which is synchronized with the oscillatory movement of the hook, said second means including adjustable means for adjusting both (a) the stroke of the feeding latch and thereby stitch length, and (b) the direction of oscillation of the feeding latch and thereby the direction of displacement of the fabric, third means drivingly connecting the main drive shaft and the needle bar for imparting rising and falling movement thereto, said third means including a driven crank, an eccentric pin on said crank controlling rising and falling movement of said needle bar, a slide block connected to said eccentric pin, a thread tensioning lever sliding without play in said slide block, and an adjustable support pivotably supporting said lever; a needle bar support having first and second support pivots about which the needle bar support is rotatable, one of said pivots being supported on said adjustable support, means adjustably supporting said adjustable support for translation movement for aligning said first and second support pivots, fourth means drivingly connecting said main drive shaft and said needle bar support for oscillating said needle bar to produce zig-zag stitches, said fourth means including adjustment means for adjusting the amplitude of the zig-zag stitches and the centered position of the needle bar, a needle plate, and fifth means for fixedly supporting said needle plate in a particular position.

2. A control mechanism as claimed in claim 1 comprising a rotatable shaft in the lower portion of the sewing machine driven by said main shaft, said eccentrics being secured on said rotatable shaft.

3. A control mechanism as claimed in claim 1 wherein said second means further comprises a pivoted arm carrying said fabric feeding latch, and a rod pivotably coupled to said second eccentric and to said pivoted arm, said adjustable means of said second means including an adjustable pivot supporting said rod, and means for displacing said adjustable pivot.

4. A control mechanism as claimed in claim 3 wherein said means for displacing said adjustable pivot comprises a knob having a slot with a V-shaped section, a pin slidable in said slot, and a lever coupled to said adjustable pivot and supporting said pin.

5. A control mechanism as claimed in claim 3 wherein said knob includes an outer rotatable section provided with said slot, and an internal member resiliently mounted in said outer section for slidable movement therein, said internal member facing said pin such that by displacement of said internal member said pin is displaceable to rock said lever and produce movement of said adjustable pivot to a position in which the direction of displacement of the fabric feeding latch is reversed.

6. A control mechanism as claimed in claim 1 wherein said slide block has a groove of prismatic shape, said thread tensioning lever having a corresponding prismatic shape slidable in said groove.

7. A control mechanism as claimed in claim 6 wherein said slide block comprises two assembled parts cooperatively defining said groove.

8. A control mechanism as claimed in claim 6 comprising a pin fixed to said eccentric pin on said crank and rotatably supporting said slide block.

9. A control mechanism as claimed in claim 1 wherein said cam is driven in oscillatory movement by said one eccentric, a toothed conical sector on said cam, and a conical pinion secured to said hook and in mesh with said conical sector for driving said hook in oscillatory movement.

10. A control mechanism as claimed in claim 1 wherein said adjustment means of said fourth means comprises a cam driven in rotation from said main drive shaft, a squared arm articulated on a fixed pivot pin, a fork secured on said arm and engaging said cam to impart oscillatory movement to said squared arm as said cam rotates, a curvilinear ramp driven with said squared arm, a roller displaceable in said ramp, a lever carrying said roller and subjected to an alternating translatory movement by said ramp, said lever being connected to said needle bar support, a first rotatable serrated sector coupled to said lever to adjust the amplitude of the zig-zag stitches in accordance with the angular position of said sector, a second rotatable serrated sector coupled to said squared arm to pivot the same on said fixed pivot pin and adjust the position of the roller in said curvilinear ramp and thereby the centered position of the needle bar, and adjustable leaf springs acting on respective serrated sectors to hold each thereof in a particular angular position.

11. A control mechanism as claimed in claim 10 wherein each leaf spring has one fixed end and an opposite end which resiliently engages one serration in the associated serrated sector.

12. A control mechanism as claimed in claim 11 wherein each leaf spring is adjustably mountable at said one end thereof.

13. A control mechanism as claimed in claim 1 wherein said needle bar support is provided with a non-circular opening corresponding to the heel end of a needle so that the needle is insertable in only a singular portion is said needle bar support.

14. A control mechanism as claimed in claim 1 wherein said fifth means comprises centering studs on said needle plate, the sewing machine having a frame with a slot having sloping faces which said centering studs engage.

15. A control mechanism as claimed in claim 14 wherein said fifth means further comprises two resilient tongues secured to said needle plate for extending through said slot in the frame to engage the latter beneath the slot.

* * * * *